United States Patent [19]

Ando et al.

[11] 4,370,764

[45] Feb. 1, 1983

[54] TOPICAL WASHING DEVICE

[75] Inventors: Shizuka Ando; Hiroshi Oyama; Toshio Yamaguchi, all of Kitakyushu, Japan

[73] Assignee: Toto, Ltd., Fukuoka, Japan

[21] Appl. No.: 249,676

[22] Filed: Mar. 31, 1981

[51] Int. Cl.[3] ..... A61H 35/00; A47K 3/22

[52] U.S. Cl. ..... 4/443; 4/420.2; 4/420.4; 4/420.5; 4/444

[58] Field of Search ..... 4/443, 444, 445, 446, 4/447, 448, 420.1, 420.2, 420.3, 420.4, 420.5

[56] References Cited

U.S. PATENT DOCUMENTS

| | | | |
|---|---|---|---|
| 1,935,201 | 11/1933 | Callejo | 4/448 |
| 2,872,687 | 2/1959 | Maurer | 4/420.2 |
| 2,875,450 | 3/1959 | Umann | 4/447 |
| 3,247,524 | 4/1966 | Umann | 4/447 X |
| 3,308,847 | 3/1967 | Umann | 4/447 X |
| 3,577,567 | 5/1971 | Wintercorn | 4/445 |
| 3,662,407 | 5/1972 | Colucci | 4/420.2 |
| 3,810,260 | 5/1974 | Lodi | 4/420.4 |
| 3,947,899 | 4/1976 | Robinson et al. | 4/447 |
| 3,995,326 | 12/1976 | Umann | 4/447 |
| 4,028,745 | 6/1977 | Caniglia | 4/420.2 |
| 4,062,071 | 12/1977 | Blanquet | 4/420.2 X |
| 4,123,807 | 11/1978 | Oguma et al. | 4/448 |
| 4,192,023 | 3/1980 | McComb | 4/420.2 X |
| 4,208,746 | 6/1980 | Minamoto et al. | 4/448 |
| 4,237,560 | 12/1980 | Riegelman et al. | 4/447 |
| 4,304,016 | 12/1981 | Oguma et al. | 4/448 X |

*Primary Examiner*—Henry K. Artis

*Attorney, Agent, or Firm*—Sandler & Greenblum

[57] ABSTRACT

A topical washing device is utilized to clean a predetermined body portion of a user. The device includes a washing nozzle for discharging washing water and a water feed line connecting the washing nozzle to a source of water. A heat exchanger, heater, temperature sensor, heat-sensitive safety switch, and controller are provided to control the temperature of water which is discharged. By using the device, water will be discharged from the device which is always comfortable to a user, even after the device has not been used for relatively long periods and when water supplied to the device varies in temperature.

22 Claims, 20 Drawing Figures

TOPICAL WASHING DEVICE

BACKGROUND OF THE INVENTION

1. Field of the Invention

The present invention generally relates to a topical washing device, and more particularly to a topical washing device which is utilized for cleaning the anus or other body part of a user after stool, as well as for other topical bathing purposes.

2. Discussion of Prior Art

Washing water discharged from topical washing devices of the above type should be temperate, and preferably should have a temperature between approximately 36° C. and 40° C.

Furthermore, the temperature of influent water normally supplied to topical washing devices varies over a wide range in accordance with seasonal and climate changes, e.g., from a level of approximately 0° C. during the winter to a level of approximately 30° C. during the summer. The temperature of washing water supplied by these devices is greatly influenced by the temperature of water supplied to the device, and it has therefore previously been difficult to maintain the washing water discharged at a stable temperature of approximately 36° C. In this regard, it is relatively easy to control the temperature of washing water which is continuously discharged by a washing device. However, under circumstances in which the washing water is discharged intermittently or after a period of inactivity the possibility of undesirable emission of overheated water caused by the thermal inertia of the heater exists.

Accordingly, there is a growing demand for topical washing devices which are capable of discharging or spouting washing water having a constant temperature, irrespective of changes in the temperature of water supplied to the devices or of the time period of non-use or inactivity of the device.

Medical data reveals that washing water of approximately 63° C. can cause a true burn to a user after approximately two seconds of exposure. As a result, users will be unavoidably burnt even when they have attempted to elude discharged water after feeling that it is too hot for their comfort. Therefore, a washing device is required which can guarantee perfect saftey against burning or other dangerous accidents.

SUMMARY OF THE INVENTION

Accordingly, it is a primary object of the present invention to provide a topical washing device which insures perfect safety against burns and similar accidents even during malfunctioning or other trouble involving with a washing water temperature controller.

In accordance with the present invention, the above object is achieved by a topical washing device as described herein which employs a heat exchanger having a heating vessel and a heated water storage vessel, both of which are formed of a high thermally conductive metal and which are located in contact with one another. The device also includes a heater and sensor located in the heating vessel on the upstream side, as viewed with respect to the passage of water therethrough, and a heat-sensitive switch which is located in the heating vessel or on the surface of a wall of a conduit leading to the heated water storage vessel on the downstream side. The heated water storage vessel has an inner volume capable of retaining a quantity of hot water which will take approximately 10 seconds to be discharged through a washing nozzle. With such a structure, even if there is a time lag after the water temperature in the heating vessel or on the surface of the conduit, or after the temperature of washing water from the heating vessel passing to the storage vessel, reaches a predetermined level, and before the water feed to the heating vessel or water jet through the washing nozzle is terminated, which time lag may be caused by a delay in action of a heat-sensitive switch or of an electromagnetic valve, water of a suitable temperature held in the storage tank will still be discharged to ensure the safety of a user.

It is another object of the present invention to correct variations in spout water temperature which are caused by variations in the influent water temperature in order to maintain a desired stable temperature when the device is at rest.

Still another object of the present invention is to provide a topical washing device which is relatively free of design limitations, water condensation problems, and problems in the location and placement of component parts therein.

Yet a further object of the present invention is to provide a topical washing device which is capable of discharging washing water of a suitable temperature during an initial stage of operation of the device and which discharges water which is always comfortable for a user.

Still a further object of the present invention is to provide a topical washing device which quickly responds to variations in temperature. Such a quick response is made possible by utilizing a ceramic heater as part of the device.

A still further object of the present invention is to provide a topical washing device having a simplified and compact construction which utilizes the interior of a ceramic heater as a water flow passage and which prevents fracture of the ceramic heater which might otherwise be caused by vibrations or external forces operating during assembly of the device or during piping work.

Yet another object of the present invention is to provide a topical washing device which is easy to assemble and disassemble, which facilitates inspection and maintenance, permits easy waterproofing of an operating switch for the device, and which increases the durability of the switch.

Yet a further object of the present invention is to provide a topical washing device which can be utilized in water closet of different sizes, particularly those with varying bowl lengths.

Still another object of the present invention is to provide a topical washing device which permits easy mounting of a heat exchanger on the device, insures high durability of the operating parts and which has an improved exterior design.

The present invention is provided for in one aspect thereof by a topical washing device for cleaning a body portion of a user. The device comprises a washing nozzle for discharging washing water towards the body portion, a water feed line connecting the washing nozzle and a source of water and adapted to conduct said water therethrough, a heat exchanger provided along the length of the water feed line and forming a portion of the water feed line, a heater provided on the heat exchanger for heating water which flows through the heat exchanger, and a sensor provided on the heat exchanger which is simultaneously sensitive to temperature of the surface of the heater and to the temperature of effluent water discharged by said heat exchanger. Additionally, a heat-sensitive safety switch is provided on the heat exchanger and is adapted to cut off a power supply as soon as water within the heat exchanger reaches a predetermined temperature level. By cutting off the power, the switch de-energizes an electromagnetic valve located along the water feed line upstream of the heat exchanger in order to terminate the water supply to the heat exchanger and simultaneously deactuate the heater on the heat exchanger to prevent overheating of water within the heat exchanger. A temperature controller is electrically connected to the heater and sensor in order to control the output of the heater in response to signals received from the sensor. The heat exchanger includes a pair of juxtaposed vessels, each of the vessels being comprised of a high thermally conductive metal. The vessels communicate with each other through a metal conduit of the same material. The heater and sensor are connected to one vessel. The other vessel is positioned downstream of said one vessel and has a volume which is sufficient to hold a predetermined quantity of washing water.

Upon study of the specification and appended claims, further objects, features and advantages of the present invention will become more fully apparent to those skilled in the art to which this invention pertains.

BRIEF DESCRIPTION OF THE DRAWINGS

The above and other objects, features and advantages of the present invention will become more apparent to those of ordinary skill in the art to which this invention pertains from the following description, taken in conjunction with the accompanying drawings, in which like reference characters designate like or corresponding parts throughout the several views, which views show by way of example preferred embodiments of the present invention and wherein.

DETAILED DESCRIPTION OF THE DRAWINGS

Figure 1:
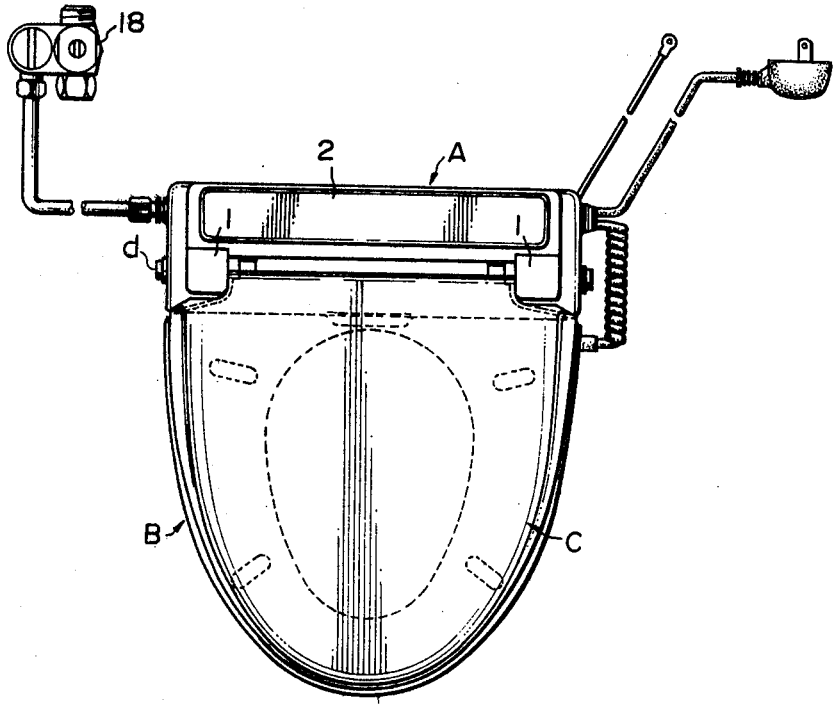
FIG. 1 is a plan view of a stool or toilet bowl with a topical washing device attached thereto in accordance with the present invention.
Figure 2:
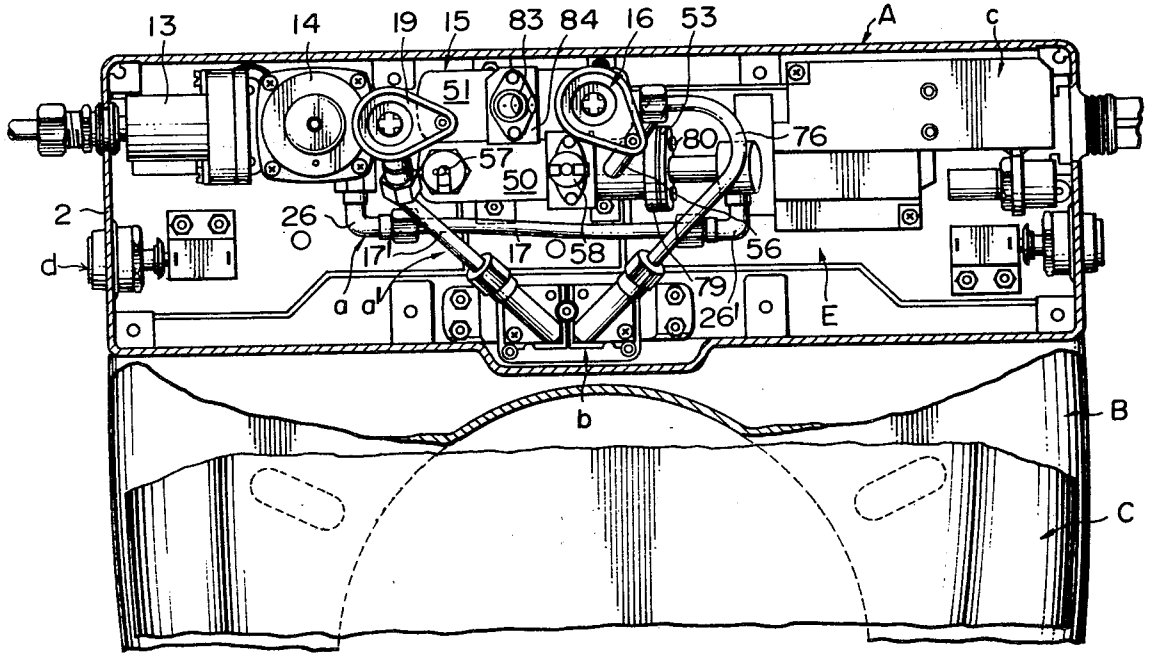
FIG. 2 is a plan view of the topical device of FIG. 1 with the top wall of its casing removed.

Referring more specifically to the accompanying drawings, and most particularly FIG. 1, the topical washing device includes casing A which houses functioning parts E. Lavatory seat B and lid C are swingably connected to casing A. Seat B and lid C are pivotably supported at their respective rear end portions on a pair of brackets 1 provided on the front side portion of casing A.

If desired, lavatory lid C can be arranged to cover and conceal functioning parts E from normal view when the lid is in its closed position. With this arrangement, it is possible to have functioning parts E be operable when the lid is opened and concealed when the lid is closed, there by effectively utilizing the opening and closing functions of the lid C. This arrangement also results in a washing device having a simple appearance and improved design and which enhances the durability of functioning parts by protecting them against dust and water splashing.

Casing A is preferably a molded synthetic resin material and comprises an open-bottom box-like cover portion 2 and a bottom plate 3 detachably connected to the bottom side of cover 2 in order to close the bottom opening of the cover.

Bottom plate 3 is provided with a pair of rectangular openings 4 along opposite plate end wall portions; the opposite end wall portions abut against the rear top surfaces of water closet bowl D when casing A is mounted thereon, openings 4 being spaced apart from one another by a distance which corresponds to the spacing between seat mounting holes 5 on bowl D.

Figure 4:
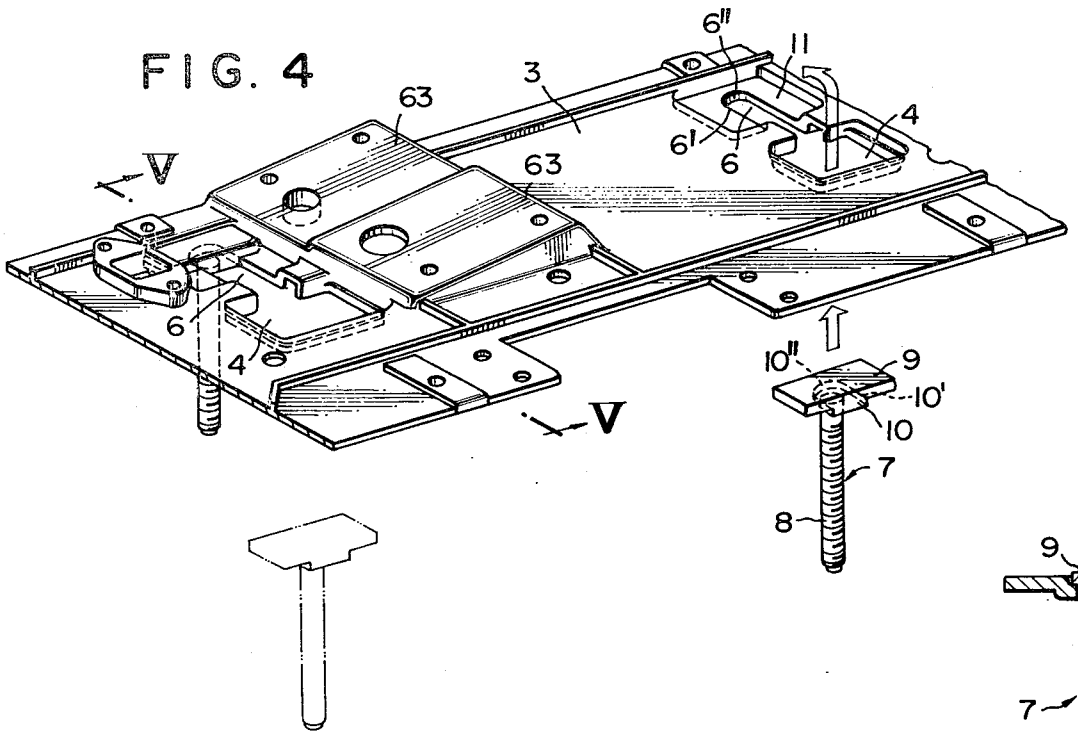
FIG. 4 is a perspective view of the bottom plate of the casing.
Figure 5:
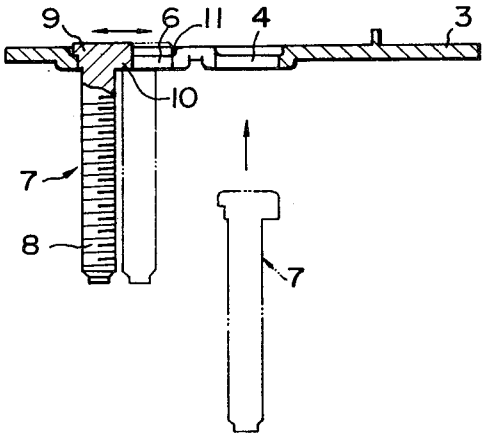
FIG. 5 is a sectional view taken along line V—V of FIG. 4.

Openings 4 are formed along substantially median between the front and rear sides of bottom plate 4, and rearwardly extending slide slots 6 extend continuously and integrally from these openings, as best illustrated in FIG. 4.

Elongated slide slots 6 are formed with a width which is broader than threaded shank portions 8 of bolts 7, the width of the slots being narrower than the width of openings 4. The slide slots are long enough so as to extend closely to the rear side of bottom plate 3, and the rear ends of these slots are of arcuate configuration. Slots 6 receive bolts slideably therein.

Bolts 7 are comprised of molded plastic and are provided with rectangular plate-like head portions 9 which are adapted to be passed through openings 4, and with threaded shank portions 8, which extend downwardly from the bottom side of head portions 9. An antirotational neck portion 10 is formed integrally with the base portion of each threaded shank 8, and this portion is smaller than slide slot 6 in width and corresponds in thickness to that of bottom plate 3.

Neck portion 10 includes straight sides 10′ which non-rotatably engage linear marginal edges 6′ of slide slot 6, and an arcuate portion 10″ (see FIG. 4) which engages arcuate end 6″ of slide slot 6.

Recesses 11 are formed in plate 3 along opposite sides of slot 6 and have a depth which corresponds to the thickness of head portion 9. Each recess 11 has a width which also corresponds to that of bolt head portion 9 and a length which is sufficient to permit displacement of the head portion within a recess.

Accordingly, bulb 7 is inserted into casing A by passing head portion 9 through opening 4 and moving it along slide slot 6 until the head portion engages recesses 11. Threaded shank portion 8 of each bolt 7 is inserted into seat mounting hole 5 of water closet bowl D, a nut 12 being threaded onto the shank portion of the bolt from its rear side to fix casing A onto the water closet D. Casing A is positioned so that seat B is pivotably supported upon cover 2 and rests on the upper rim portions of the bowl of the water closet.

In this fashion, the position of casing A is adjustable within a range which is determined by the length of slide slot 6.

With this arrangement, the position of casing A is adjustable within a range determined by the length slide slots 6, the adjustability being dependent upon the length of water closet D and the spacing from seat mounting holes 5 to the front end of the water closet. Accordingly, it is possible to adjust the forward position of seat B by shifting the mounting position of casing A forwardly or rearwardly, i.e., to provide a versatile device which is adaptable for use with water closets having differently sized bowl tops.

The functioning parts E include water feed line (a), washing nozzle (b), controller (c) and operating switch (d), these elements being mounted on bottom plate 3 and being housed in casing A. The functioning parts also include switch manipulating portion $d_2$, which is described in greater detail hereinafter. The switch manipulating portion is not housed within casing A.

Figure 3:
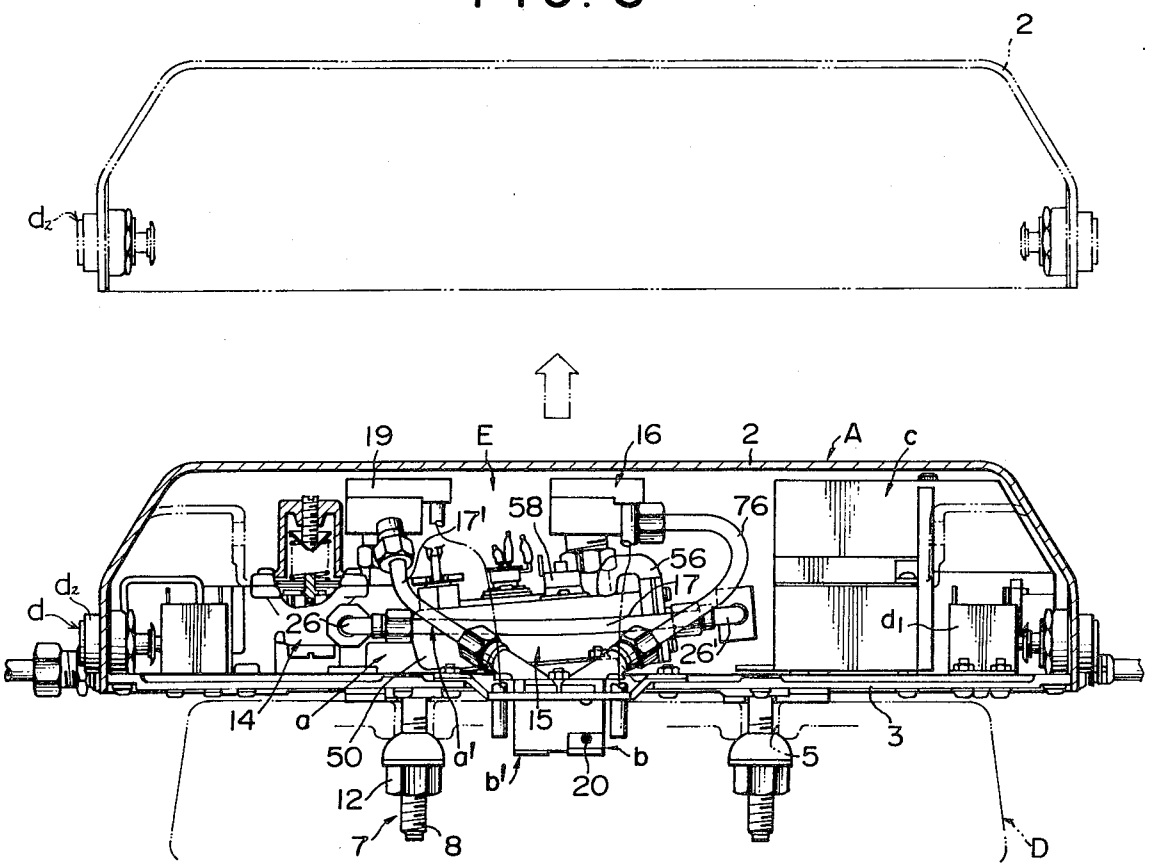
FIG. 3 is a front view of a topical washing device having the side wall of its casing removed.

Since all of the components or elements which comprise functioning unit E are mounted on the bottom plate without any lead wires attached to cover 2, there is no possibility of loose lead wires being caught between the cover and bottom plate when the elements are assembled. The absence of loose lead wires on cover 2 facilitates assembly and disassembly as well as inspection, maintenance and service of the topical washing device. Water feed line (a) includes, in series, flow regulator valve 14, which is integrally attached to electromagnetic valve 13, heat exchanger 15, and first vacuum breaker 16. The vacuum breaker serves as a check valve. This series of elements communicate with one another directly or via connecting pipes 17, as seen in FIG. 3. The feed line communicates with washing nozzle (b) at its downstream end and with distributor 18 at its upstream end. The distributor projects outwardly of casing A through cover 2 and serves as a connector to a water source, e.g., a service pipe or similar source.

Additionally, water feed line (a) includes auxiliary water feed line a′ which branches off from a secondary side of flow regulator valve 14.

Auxiliary water feed line a′ consists of a second vacuum breaker 19 and an auxiliary nozzle b′ which communicates with breaker 19 through connecting pipe 17′. Vacuum breaker 19 communicates with the secondary side of flow regulator valve 14.

Washing nozzle b and auxiliary nozzle b′ are mounted adjacent to one another in side by side fashion and project or extend downwardly from bottom plate 3 so that spout end 20 of the washing nozzle is positioned centrally with respect to lavatory seat B. The spout is preferably directed towards the anus or other public region of a user who is seated on or astride seat B. Spout end 20′ of auxiliary nozzle b′ is directed towards rear rim surface 21 (see FIG. 6d).

Flow passage 25 of flow regulator valve 14 fluidically connects inlet port 23 and outlet port 24 of valve casing 22 and comprises a portion of water feed line (a). Outlet port 24 includes an elbow joint 26 which is threaded for communication with heat exchanger 15 via connecting tube 17. The connecting tube comprises a nylon hose connected to the elbow joint.

Figure 6A:
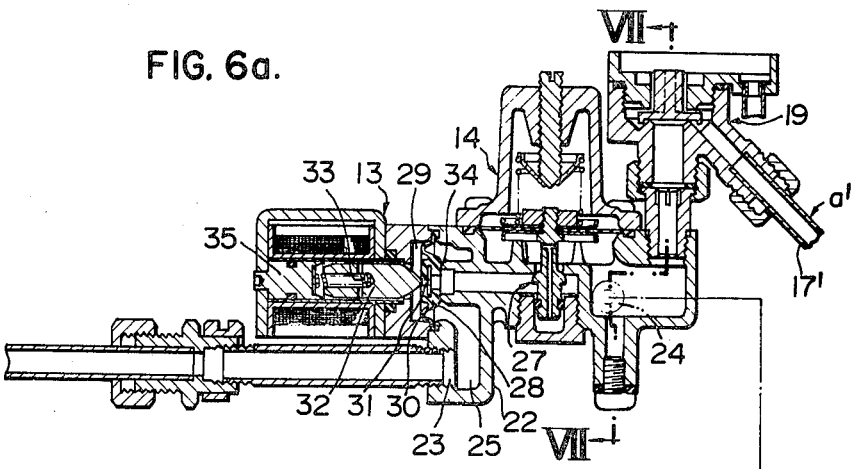
FIG. 6 is a schematic view showing the water feed line which is a portion of the topical washing device, FIG. 6(a) comprising a vertical section of a flow regulator valve formed integrally with an electromagnetic valve, FIGS. 6(b) and 6(c) being vertical sections of a heating vessel and a hot water storage vessel, respectively, of a heat exchanger forming part of the water feed line, and FIG. 6(d) being a schematic view of a washing nozzle forming a portion of the water feed line.
Figure 6B:
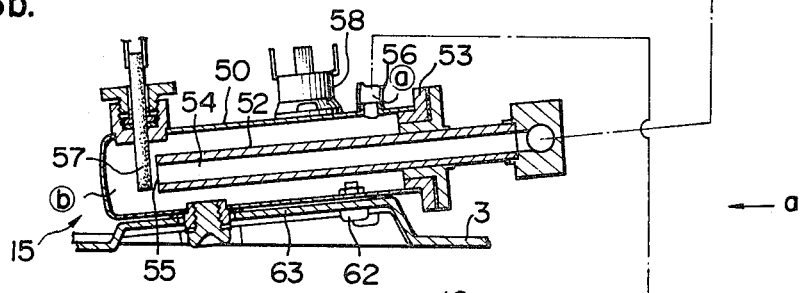

Flow passage 25 contains along its length diaphragm valve 28 which is positioned upstream of valve portion 27 to close and open flow passage 25. This is best shown in FIG. 6(a). In other words, the first and second sides of flow passage 25 are positioned side by side along the same side of diaphragm valve 28 or along the opposite side of pressure chamber 29, which is located behind diaphragm valve 28.

Pressure chamber 29 communicates with the first side of flow passage 25 via small hole 30, which is formed in diaphragm valve 28, as well as with a second side of the flow passage via port 31, which is provided along the center of diaphragm valve 28. Port 31 is closed under the influence of biasing spring 33, the spring exerting a biasing force upon plunger 32 which comprises a valve body for electromagnetic valve 13.

Under these conditions, equal pressure prevails along the first side of the flow passage and the pressure chamber 29 so that diaphragm valve 28 engages opposed valve seat 34 to close flow passage 25. If electromagnetic valve 13 is energized, plunger 32 recedes or is withdrawn by its attraction to fixed iron core 35, uncovering port 31 and thereby permitting water in pressure chamber 29 to flow into the second side of the flow passage. Accordingly, the pressure within pressure chamber 29 rapidly drops.

At this point, diaphragm valve 28 is pushed away from seat 34 by water pressure from the first side, and the first and second sides of flow passage 25 communicate with one another fluidically, allowing feed water to flow outwardly from outlet port 24 and through the regulator valve portion towards heat exchanger 15 via water feed line (a).

The description of the construction and operation of flow regulator valve 14 itself is not included herein, because such construction and operation are generally conventional.

Electromagnetic valve 13 can be turned on and off by manipulation of operating switch (d), which switch is provided projecting outwardly from casing A, e.g., outwardly from a side wall of cover 2. Operating switch (d) is also electrically connected to a controller (c), which will be described in greater detail hereinafter, in order to actuate the controller and the electromagnetic valve simultaneously. Operating switch (d) comprises a main switch assembly $d_1$ mounted on bottom plate 3 of the casing and a manipulating portion $d_2$ which is attached to casing cover 2.

The switch is best seen in FIG. 3 and is split into the main switch assembly $d_1$ and manipulating portion $d_2$, which switch portions are separately mounted on bottom plate 3 and cover 2 of casing A as described above. Accordingly, when waterproofing of the operating switch is required, there is no need to employ an entirely waterproof switch, because waterproofing treatment will only be required for manipulating portion $d_2$. This enables adequate waterproofing to be obtained at a reduced cost.

Additionally, separation of manipulating portion $d_2$ from main switch assembly $d_1$ permits greater freedom in the design of manipulating portion $d_2$ and facilitates assembling, disassembling, and inspection of cover 2, the cover having no lead wires attached thereto. Furthermore, it is possible to provide manipulating portion $d_2$ with an enlarged size relative to the size of main switch assembly $d_1$, or vice versa, in order to improve the durability and/or facility of use of the switch.

Figure 11:
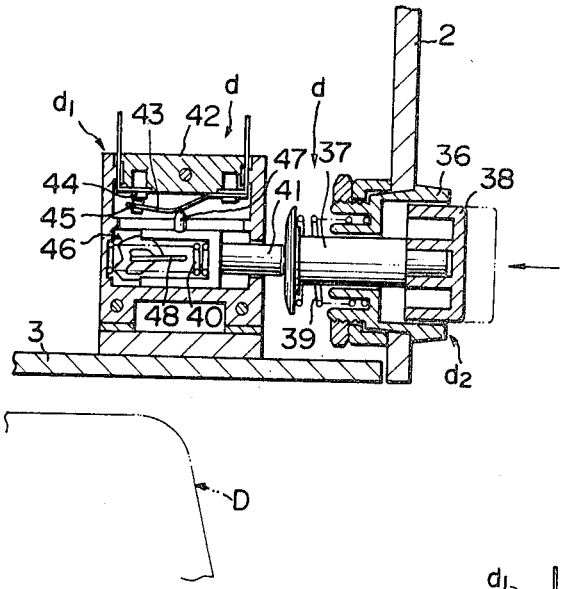
FIGS. 10 and 11 illustrate an operating switch, FIG. 10 being a vertical sectional view of the switch in its OFF position and FIG. 11 being a vertical sectional view of the switch in its ON position.
Figure 10:
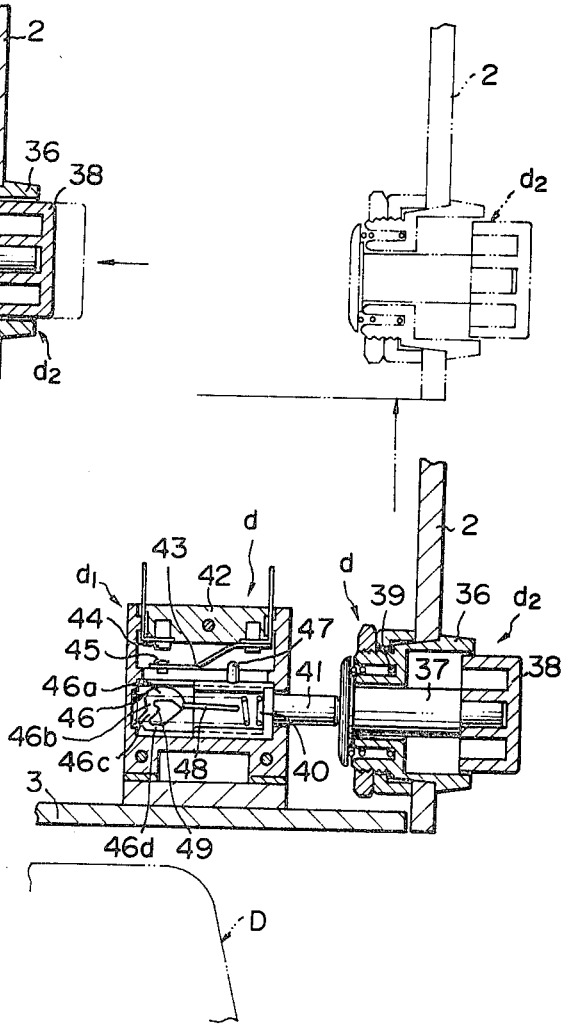

Manipulating portion $d_2$ of the switch includes guide cylinder 36, as seen in FIGS. 10 and 11, the cylinder being fixedly attached to casing cover 2 through its side wall. The manipulating portion also includes push rod 37 which is slidably inserted within guide cylinder 36, and push button 38 which is attached to the outer end of push rod 37 on the outer side of cover 2. The push rod 37 is biased inwardly of casing cover 2 by spring 39.

Spring 39, which is weaker than spring 40 of main switch assembly $d_1$, urges the inner end of push rod 37 into continuous abutting engagement with operating rod 41 without interfering with the operation of the main switch assembly. Main switch assembly $d_1$ is provided separately from manipulating switch $d_2$ as set forth above, is built within casing 42 and fixedly mounted on bottom plate 3 in opposed relation to manipulating portion $d_2$ and in a position which is slightly spaced away from the side wall of casing cover 2. This is shown in FIGS. 10 and 11. A pair of contacts 44 and 45 are provided in the upper portion of casing 42, one of the contacts being fixed on the ceiling of upper wall of casing 42 and the other one being fixed at the forward end of leaf spring 43 which extends along the ceiling wall. Casing 42 receives operating rod 41 which is inwardly and outwardly moveable along leaf spring 43; the casing includes a grooved guide 46 for guiding and restricting the inward and outward movements of operating rod 41. Operating rod 41 is biased towards manipulating portion $d_2$ by spring 40 and has its outer end projecting outwardly of casing 42 for abuttingly engaging the push rod of manipulating portion $d_2$.

Leaf spring 43 extends obliquely towards operating rod 41, which rod includes a pin 48 which engages guide 46, and a projection 47, the projection being provided at a generally median point of the circumferential surface of the rod in opposed relation to leaf spring 43. Projection 47 is adapted to push leaf spring 43 upwardly as operating rod 41 is moved inwardly in order to bring contact 45 of leaf spring 43 into engagement with contact 44 on the ceiling wall of casing 42.

Push rod 37 of manipulating portion $d_2$ is biased towards operating rod 41 by spring 39 because otherwise button 38, which is depressed when in its ON condition, might spontaneously pop out when subjected to vibrations or similar forces, making it difficult to discriminate between its ON and OFF positions. Additionally, the above described arrangement is advantageous because the manipulating portion is always held in intimate contact with the main switch body.

Figure 12:
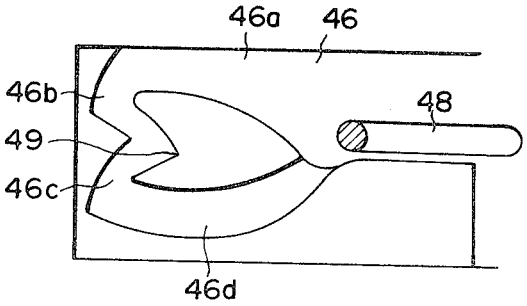
FIG. 12 is an enlarged view of a cam portion of the switch.

Guide 46 includes a first portion **46*a*, second portion 46*b*, third portion 46*c*, and fourth portion portion 46*d* (see FIG. 12). First portion 46*a* extends generally in the direction of advancement of operating rod 41, second portion 46*b* extending from one end of first portion 46*a* generally rearwardly back towards the beginning of the path of movement of operating rod 41, third portion 46*c* extending from the terminal end of the second portion forwardly in the general direction of movement of the operating rod when it is advancing, and the fourth portion extending from the end of the third portion rearwardly in the general direction of withdrawal or retraction of rejection rod 41. The fourth portion communicates with the first end of first portion 46*a*. The second and third portions obliquely intersect to form a trap 49 at their point of intersection. Guide 46 is best illustrated in FIGS. 10–12**.

By depressing button 38 of operating switch (d), operating rod 41 is advanced, leaf spring 43 thereby being pushed upwardly by camming projection 47, and contacts 44 and 45 thereby being engaged to place the switch into its ON position. When a user's finger is removed and button 38 thereby is relieved of any depressing force, operating rod 41 is biased rearwardly and outwardly by spring 40, thereby allowing pin 48 to fall into trap 49.

Under such circumstances, operating rod 41 is in a slightly retracted position so that the switch is continuously maintained in its ON state and button 38 in a depressed condition by spring 39.

When button 38 is again depressed, operating rod 41 is moved slightly in its forward or advanced direction along portion **46*c*, thereby disengaging itself from trap 49. Accordingly, once the depressing force on button 38 is removed, operating rod 41 will be retracted into its initial position, thereby relieving leaf spring 43 from the pushing force which is exerted by projection 47. This, in turn, opens contacts 44 and 45 to turn off the switch. On the other hand, as a result of retraction of the operating rod, push rod 37 is forced rearwardly against the biasing force of spring 39, thereby returning button 38 into its initial position in which it projects outwardly from guide cylinder 36**.

Electromagnetic valve 13 is thus energized by activation of operating switch (d), which in turn allows water to flow into heat exchanger 15 through flow regulator valve 14. Electromagnetic valve 13 is de-energized when switch (d) is turned off, thereby cutting the water feed to the heat exchanger.

The heat exchanger comprises heating vessel 50 and hot water storage vessel 51. These vessels are illustrated in FIGS. 6(*b*) and 6(*c*). The heating vessel comprises a cylindrical copper container which is open at one end and a tubular ceramic heater 52 which is mounted through a central portion of lid 53; the lid is utilized to close the open end of the vessel. Heating vessel 50 communicates with the upstream side of water feed line (a) via an axial bore provided throughout the ceramic heater, and with hot water storage vessel 51 via conduit 56. The conduit comprises a copper pipe provided through the upper wall of vessel 50 at a position which is remote from water delivery end 55 of axial bore 54.

Heating vessel 50 includes a compensating sensor 57 located in a position adjacent to water delivery end 55 and a heat sensitive safety switch 58 mounted on the outer surface of the vessel. The heat sensitive switch can comprise a bi-metallic switch.

Hot water storage vessel 51 comprises a closed copper cylinder having an inner volume sufficient for holding a quantity of hot water which will take approximately 10 seconds when spurted through washing nozzle (b). Vessel 51 is brazed to and along heating vessel 50 with the respective circumferential walls of the vessel in intimate contact with one another.

Figure 6C:
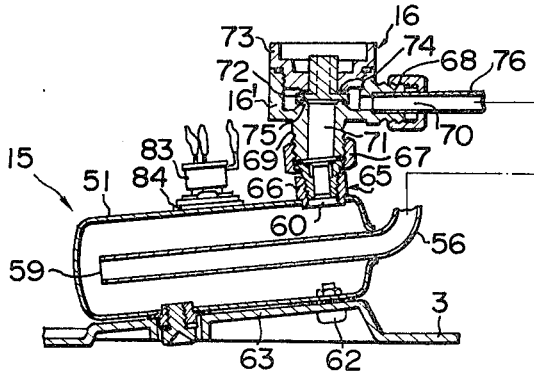
Figure 6D:
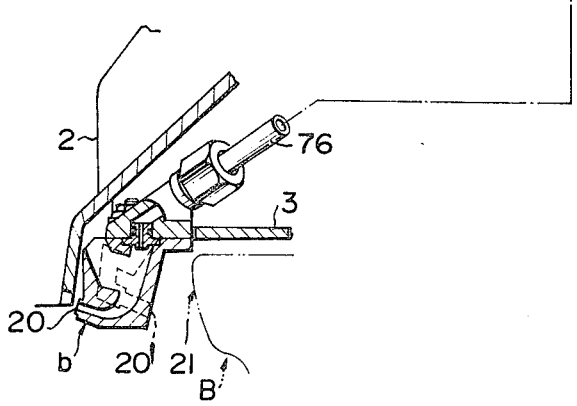

Conduit 56, which fluidically intercommunicates the heating and storage vessels, extends through one side wall of heating vessel 51 and axially through the storage vessel to a point which is adjacent to an opposite side wall of the vessel from its point of entry as in FIG. 6*c*. Storage vessel 51 is provided with water outlet 60 along its upper wall, the water outlet being located at a position as distant as possible from delivery end 59 of duct 56.

Heat exchanger 15 is mounted on bottom plate 3 by a pair of mounting plates 61 which are attached to the bottom plate by bolts, nuts or other suitable attachment means 62. Bottom plate 3 includes a sloped surface 63, as illustrated in FIG. 6(*c*), onto which heat exchanger 15 is attached, and therefore water outlet 60 will be positioned on the upper side of the heat exchanger.

Because of sloped section 63, heat exchanger 15 can be mounted at a predetermined angle and with water outlet 60 at an upper portion of the heating vessel simply by placing the heat exchanger on the bottom plate. Accordingly, there is no need to utilize any special machining operations to attach the heat exchanger onto the plate in an inclined fashion or for brazing legs onto the bottom of the exchanger. Consequently, the position of the heat exchanger will not be adversely affect by dislocation of such legs and can be provided with precise dimensions relative to its angle of inclination. This facilitates mounting of the heat exchanger and improved efficiency in assembly, contributing to a reduced production costs.

It is relatively easy to form sloped section 63 in bottom plate 3, which is molded, without incurring any substantial cost increase.

Heat exchanger 15, which is mounted in an inclined position, includes water outlet 60 on its upper side so that any bubbles appearing on the surface of boiling water therein will promptly move towards the water outlet and be dissolved into the surrounding water for discharge through the outlet.

Accordingly, heater 52 will be maintained free of cracking or other similar damage, which would be otherwise caused by a foamy layer formed in heating tank 50, by locally aggregating bubbles which would cause differences in the thermal conductivity along different parts of the heater located on opposite sides of the foamy layer. Of course, other disadvantages and problems involving heater 52 and sensor 64 which are caused by such cracking damage will also be prevented.

Heat exchanger 15 includes a bush nut 65 which is brazed to the water outlet 60 perpendicularly with respect to the longitudinal axis of hot water storage tank 51. Bush 66 is threaded into bush nut 65 and rotatably supports box nut 67, a first vacuum breaker 16 being threadably attached to the box nut.

When the first vaccum breaker is mounted, box nut 67 is tightened while holding the outlet port of the vacuum breaker in a predetermined direction. Main body portion 16' of the vacuum breaker comprises a molded synthetic resin material which prevents warm water from cooling off during its passage through the breaker.

The first breaker includes a port 68 which communicates with the downstream side of water feed line (a), i.e., with washing nozzle (b). The breaker also includes a port 69 which is fluidically connected to heated water storage vessel 51. The connections are achieved through water passages 70 and 71, respectively, as illustrated in FIG. 6(*c*).

Water passage 71, which communicates with heated water storage vessel 51, is inclined from the axis of water outlet 60 at the same angle of inclination as heat exchanger 15. In other words, heated water storage vessel 51 and water passage 71 are generally similarly inclined.

Valve body 72 is provided between water passages 70 and 71 and is supported by plug 73. Plug 73 is, in turn, threaded into casing 16' of the first vacuum breaker. Valve body 72 is adapted to be moved upwardly and downwardly through a small clearance in seat portion 74 at the lower end of plug 73. More particularly, a suction valve is comprised by the upper surface of valve body 72 and the seat portion 74 of plug 73. A check valve is comprised by the lower surface of valve body 72 and a seat portion 75 formed at the upper end of water passage 71.

After mounting first vacuum breaker 16 on heat exchanger 15 as described hereinabove, bush nut 65 is brazed generally perpendicularly to heat exchanger 15. By angling the axis of water passage 71 from the axis of the water outlet of heat exchanger 15 through the same angle of inclination as the heat exchanger is angled with respect to the plate, in order to form seat portions 74 in generally level fashion, brazing is facilitated and can be more accurately performed without the complicated machining operations which would be otherwise required. Additionally, when the first vacuum breaker is formed from a molded synthetic resin material, it is easier to form inclined passage 71 more precisely and at a reduced cost.

Additionally, because first vacuum breaker 16 is integrally attached to heat exchanger 15 via bush 66, its outlet can be turned to any desired direction.

Heated water which passes through the first vacuum breaker is directed forwardly through feed pipe 76 and spouted from the washing nozzle.

When the operating switch is turned off, water which remains in the pipes and the component parts of the device downstream of first vacuum breaker 16, and more particularly water which remains in feed pipe 76 and washing nozzle (b), is spontaneously drained through the washing nozzle due to the action of the first vacuum breaker as a suction valve.

When water is not being spouted or discharged from the washing nozzle, i.e., when the device is not in operation, water which remains in the first vacuum breaker and which is in communication with heated water in storage vessel 51, will be kept warm by convection.

Ceramic heater 52 comprises an aluminum tubular body having an axial bore 54, a heating element 77 and a temperature sensor 54 which are positioned adjacent to one another in side-by-side or juxtaposed fashion along the circumferential surface of the tubular body. The heating element and sensor are covered by an extremely thin surface layer of aluminum. The heater is supported centrally within lid 53 of heating vessel 50.

Ceramic heater 52 is inserted axially into heating vessel 50 by fitting lid 53 into the open end of the vessel or tank so that it will be maintained at a suitable distance from the inner peripheral surface of the heating vessel.

When lid 53 is fit into position at the open end of the heating vessel, heating element 77 and sensor 64 are positioned within heating vessel 50 and have respective terminals 78 which are located on the surface of the base portion of heater 52, which portion projects outwardly from lid 53.

As described hereinabove, heater 52 includes heating element 77 and sensor 64, which are covered by an aluminum coating. This aluminum coating is stable in its electric insulating qualities, in its durability, heat resistance and resistance against chemicals, so that there is little or no possibility of the sensitivity of the sensor being reduced by decomposition of the coating layer which may be caused by the water temperature or variations in water temperature. Similarly, the coating will not disintegrate and thereby create problems with sensor 64 and heating element 77. In this fashion the heater assures safety and provides a high sensitivity over long periods of time.

Furthermore, heating element 77, which contacts water only through the extremely thin aluminum coating layer, has a high heating efficiency and is capable of instantaneously heating water upon contact therewith. As a result, there is no need for retaining water in a tank or similar container for purposes of heating, and it thus becomes possible to fabricate the present washing device in a compact fashion and at a reduced cost.

Additionally, heater 52, which includes sensor 64 and heating element 77 embedded or printed along the same plane, permits quick and accurate temperature detection, which proves advantageous in maintaining and controlling stable temperatures.

Elbow joint 26' is securely attached at one end to the base of heater 52 in communication with bore 54 and adapted to be connected at its other end to nylon hose 17. Lid 53 is attached to a flange at the open end of heating vessel 50 by screws 80. In order to couple heat exchanger 15 to flow regulator valve 14, elbow joint 26' is attached to ceramic heater 52 and, after connecting to one of its ends to nylon hose 17, lid 53 is attached to heating vessel 50. Thereafter, the other end of nylon hose 17 is connected to elbow joint 26, which is in turn connected to the flow regulator valve as in FIG. 8.

Ceramic heater 52 of the heat exchanger is connected to valve 14 via flexible nylon hose 17 on the upstream side. The hose compensates for any irregularities in the dimensions of the ceramic heater after sintering and prevents the imposition of unnecessary forces on the ceramic heater during piping work, in addition to absorbing vibrations and/or other externally applied forces. It also acts to prevent the imposition of destructive bending forces on ceramic heater 52 during piping work and to preclude rupturing of the ceramic heater due to vibrations or similar forces. Furthermore, the connection of ceramic heater 52 with valve 14 on the upstream side is facilitated, thereby permitting improvement of working efficiency as well as reducing production costs.

Figure 8:
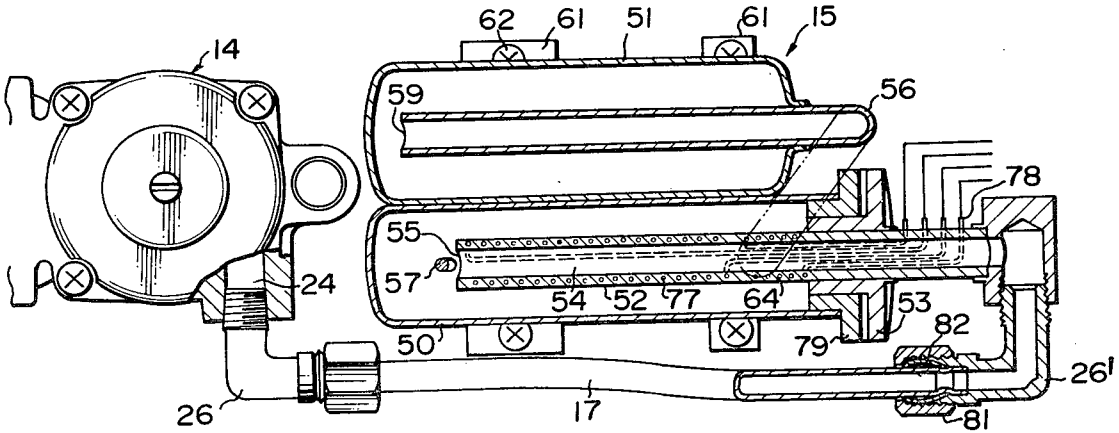
FIG. 8 is a horizontal sectional plan view of the heat exchanger forming a portion of the water feed line.

In FIG. 8, a box nut 81 is shown as being threaded onto gripper 82. As the box nuts are threaded, the nylon hose is securely gripped within elbow joints 26 and 26', respectively.

Heating element 77 and sensor 64 of heater 52 are electrically connected to controller (c) and, through the controller, to a power source which constantly energizes heating element 77.

Figure 13:
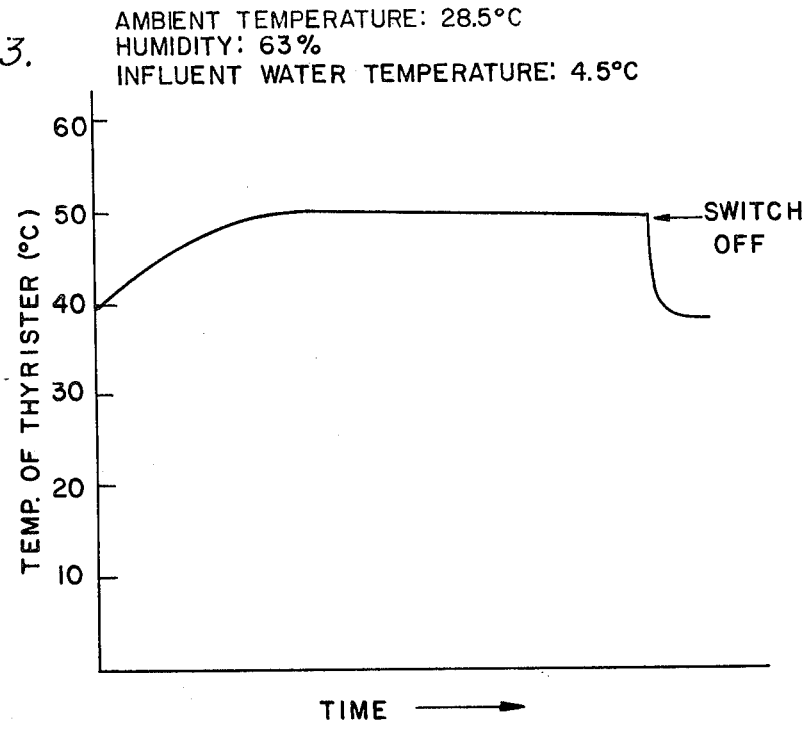
FIG. 13 is a graph of the temperature of a thyristor measured over time.

Controller (c) is an electronic circuit which employs a thyristor 83, which controls the output of heating element 77 of heater 52 by increasing or reducing the effective current to heater 77 in response to signals received from sensor 64. In this fashion the controller continuously controls the water temperature within heat exchanger 15 in a range between approximately 36° C. and 40° C. Thyristor 83 is attached to the surface of heated water storage vessel 51 by mounting plate 84 and fixed in position by screws or other suitable attachment means. The thyristor is attached to the surface of storage vessel 51 because of the cooling effect which is illustrated in FIG. 13. The graph of FIG. 13 illustrates the temperature of thyristor 83 as a function of time under the indicated conditions, and makes clear that a sufficient cooling effect on the thyristor results even when it is subjected to a maximum temperature increase. In other words, the surface temperature of thyristor 83 will remain at 50° C. even though the influent water temperature is quite low and the feed rate and temperature of the washing water are at a maximum.

Accordingly, thyristor 83 can be sufficiently cooled without providing a radiator plate and without mounting the thyristor on a water feed pipe.

It therefore follows that there is no need to use a radiator plate which could impair the design of the washing device or restrict the design or mounting position of casing A, thereby permitting fabrication of the present washing device at a reduced cost. Additionally, no drop in electrical insulation qualities will arise due to the presence of water condensation because the water within storage vessel 51 will be maintained at a temperature sufficiently higher than the ambient temperature and generally in a range of between approximately 36° C. and 40° C.

Thermostatic safety switch 58, which can be a bimetallic switch, is provided to prevent overheating which might occur in the event of problems in controller (c). This switch is normally set to deenergize electromagnet valve 13 and cut off the water feed or supply as soon as the temperature from the surface of heating tank 50 reaches a preset level of 50° C. The switch can be preset at any desired temperature level.

Figure 14:
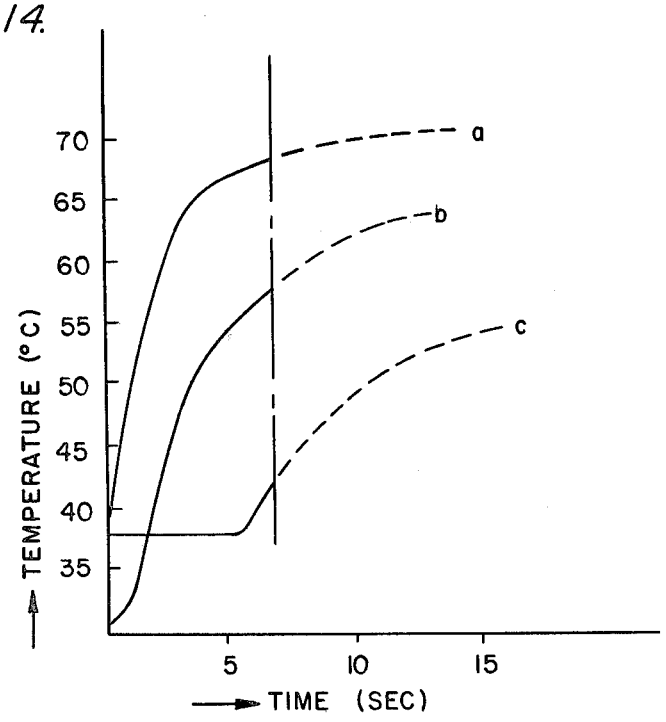
FIG. 14 is a graph illustrating the variations in temperature of effluent liquid from a storage vessel measured over time.

In the event of problems with controller (c), the effluent temperature of water from heating vessel 50, i.e., the water temperature which exists at level "a" in FIG. 6(b), increases as illustrated by curve "a" in the graph in FIG. 14.

The surface temperature of heating vessel 50 or the surface temperature of conduit 56 at position "a" will vary over time as indicated by curve "b" in FIG. 14.

Curve "c" of FIG. 14 indicates the variations in temperature of effluent water from storage vessel 51, i.e., the temperature of washing water spouted from washing nozzle (b).

As is clear from the graph in FIG. 14, when bimetallic switch 58 mounted on the surface of heating vessel 50 is set at 50° C., the temperature at the surface of the bi-metallic switch reaches 50° C. within seconds. Thus, even considering any time lags which may exist or be required until bi-metallic switch 58 and electromagnetic valve actually function, the discharge spout can be shut off within seven seconds as indicated by the vertical line on the graph. By such time, the temperature of the water discharged, from heating vessel 50 will have reached approximately 70° C., but the temperature of effluent from storage vessel 51 will be below 42° C. This assures safety for a user even when controller (c) malfunctions. Switch 58 is simpler in structure than mechanical temperature responsive switches, and additionally has increased durability and fast temperature-responsive characteristics, thereby making it possible to reduce the size of storage vessel 51. It is also possible to provide switch 58 on the surface of conduit 56 outside of the storage vessel.

fluent temperature are best illustrated in the following Table 1.

TABLE 1

| Influent Temperature | Spout Temperature | Input Power | Temperature of Sensor | Resistance of Sensor |
|---|---|---|---|---|
| 30° C. | 38.0° C. | 199 W | 46° C. | 56 ohm |
| 5° C. | 30.5° C. | 635 W | 46° C. | 56 ohms |

Table 2 is similar to Table 1 but also takes into consideration resistance of the compensating sensor.

TABLE 2

| Influent Temp. | Spout Temp. | Input Power | Temp. of Sensor | Resistance of Sensor | Temp. of Compensating Sensor (at "a", FIG. 1) | Resistance of Compensating Sensor |
|---|---|---|---|---|---|---|
| 30° C. | 38° C. | 199 W | 46.0° C. | 56 ohms | 32° C. | 34 ohms |
| 5° C. | 38° C. | 822 W | 50.5° C. | 57 ohms | 12° C. | 23 ohms |

Figure 15:
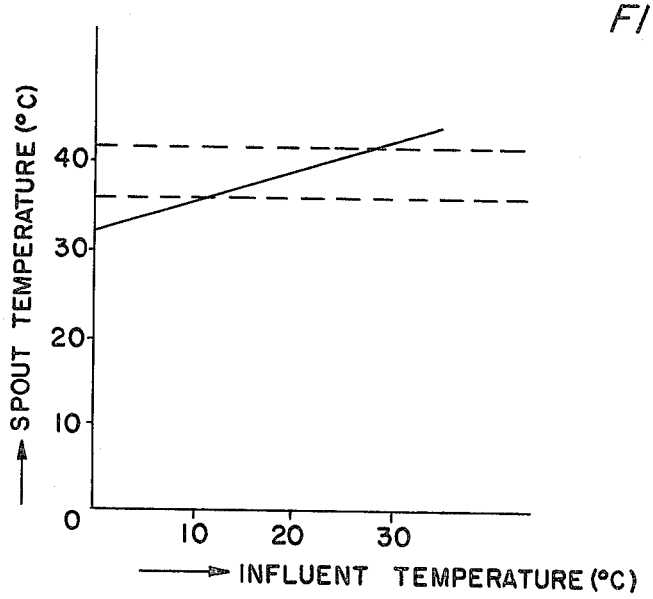
FIG. 15 is a graph illustrating the variations in effluent or spout water temperature plotted against the temperature of influent water to the device.
Figure 16:
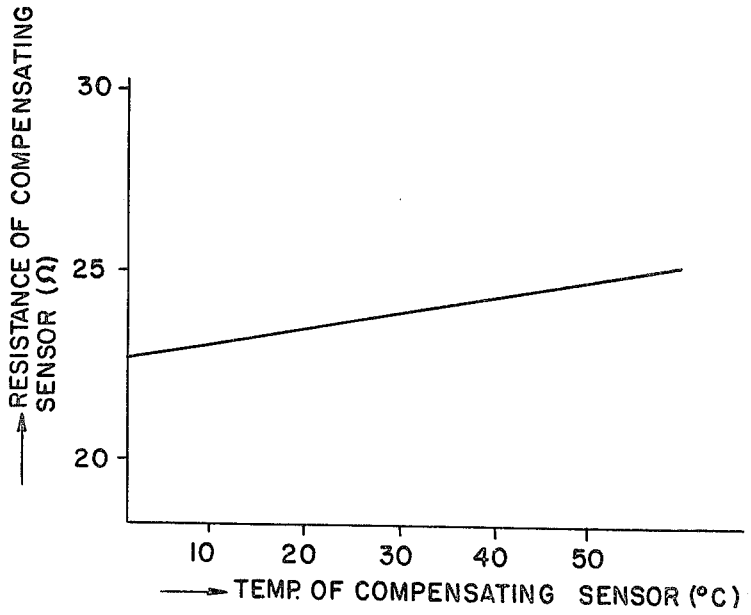
FIG. 16 is a graph illustrating the resistance of the compensating sensor as plotted against its temperature.

Compensating sensor 57 is provided to solve and correct problems in variations in effluent or spout water temperature, dependent upon the temperature of influent water, as illustrated in the graph in FIG. 15. The sensor is provided to control the spout water temperature at a stable specified level when using the washing device after it has remained inoperative or at a rest for a long period of time. Compensating sensor 57 has the resistance and temperature characteristics which are illustrated in the graph in FIG. 16, and is located in heating vessel 50 in a position adjacent to inlet 55 and in series with sensor 64. The sensor is capable of adjusting the bridge resistance of the circuit at a spout temperature of approximately 38° C.

Variations in the spout temperature which depend upon the influent temperature are attributable to the sensitivity of sensor 64, both with respect to influent temperature and to heat received from heating element 77. Sensor 64 is embedded within an aluminum layer and is adjacent to heating element 77. The sensor is sensitive to the influent temperature and to the heat received directly from heating element 77; the heat received from this heating element requires a higher wattage to produce heat in an increased quantity when the influent temperature is low.

More particularly, the temperature of sensor 64 itself increases even if spout water temperature is lower than at a low wattage. On the other hand, because the operating temperature of sensor 64 is determined by the circuit arrangement of controller (c), a temperature increase will be prohibited as soon as the operating temperature of sensor 64 is reached, notwithstanding the low spout temperature. This causes a drop in the spout temperature or a temperature difference of approximately 9° C., as opposed to a temperature difference of about 30° C. in the effluent temperature illustrated in the graph of FIG. 15.

Figure 17:
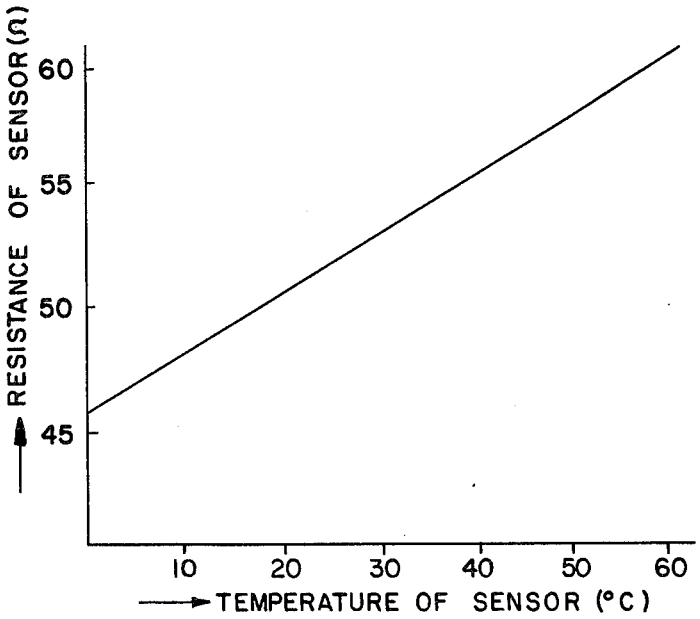
FIG. 17 is a graph illustrating the resistance of a sensor plotted against its temperature.

The graph in FIG. 17 illustrates characteristics of temperature sensor 64. The temperature of sensor 64, its input power, and the spout temperature relative to in- In this case, the control circuit is arranged to have its ON-OFF level at a sensor temperature of approximately 46° C., or at a resistance of 56 ohms, the heater becoming sensitive to the OFF position when the temperature exceeds 46° C. by any amount, and to the ON position when the temperature drops below 46° C. by any amount.

The circuit arrangement is therefore altered by inserting a compensating sensor having a critical ON-OFF point at a level where the combined resistance of the sensor and the compensating sensor equals 80 ohms. As seen in the tables, when the influent temperature is 30° C. and the spout temperature is 38° C., the sensor temperature will be 46° C. (equal to a resistance of 56 ohms), which is the same as in the situation where no compensating sensor is inserted.

When the influent temperature is 5° C., the temperature at the compensating sensor is slightly increased to 12° C., but its resistance is reduced by 1 ohm to 23 ohms.

However, because the circuit is calibrated to a composite resistance of 80 ohms, the ON-OFF operation is not effected until the sensor resistance becomes 57 ohms. Accordingly, the sensor temperature reaches 50.5° C., and even when a large amount of heat is transmitted to the sensor from the heater, ON-OFF operation will not occur until the temperature reaches a somewhat higher level, e.g., 50.5° C. The spout temperature is thus raised from 30.5° C. to 38° C., the former temperature being obtainable when the compensating sensor is not provided. In this manner, the spout temperature can be maintained irrespective of variations in the influent temperature.

Figure 9:
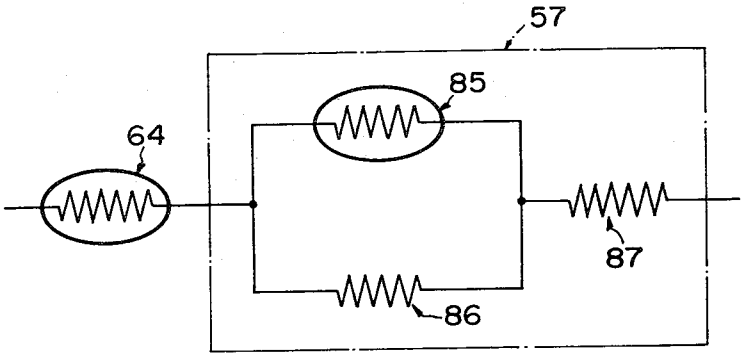
FIG. 9 is a circuit diagram for a compensating sensor forming a portion of the device.
Figure 7:
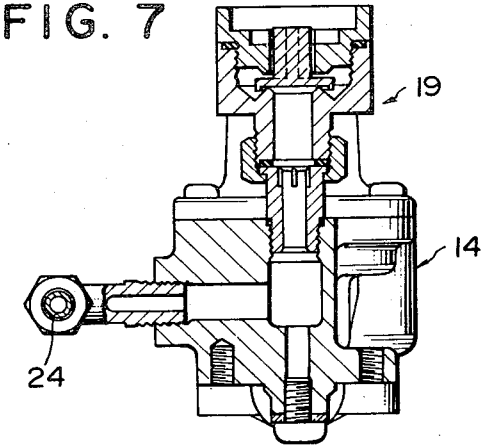
FIG. 7 is a sectional view taken along line VII—VII of FIG. 6(a)
Figure 18:
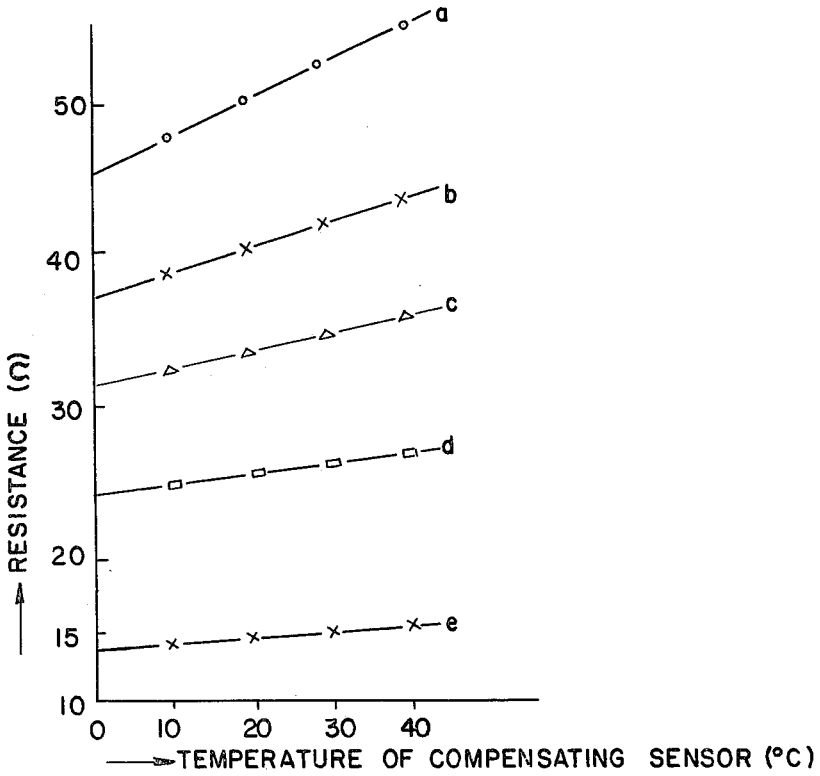
FIG. 18 is a graph illustrating resistance of the compensating sensor as plotted against its temperature.

In the case where compensating sensor 57 has an adjusting resistance 86 in parallel with a primary compensating sensor 85, as illustrated in FIG. 9, it is possible to provide a temperature control which, according to the calculated values illustrated in Table 3 hereinbelow, is linear, and which permits an arbitrary temperature gradient, as shown in the graph in FIG. 18. Furthermore, the absolute value can be arbitrarily determined by inserting an adjusting resistance 87 in series to obtain the desired or necessary characteristics.

TABLE 3

| Temp. of primary compensating sensor | Resistance of primary compensating sensor ⓐ | Composite resistance of primary compensating sensor & parallel adjusting resistance | | | |
|---|---|---|---|---|---|
| | | Parallel resistance: 200 Ω ⓑ | Parallel resistance: 100 Ω ⓒ | Parallel resistance: 50 Ω ⓓ | Parallel resistance: 20 Ω ⓔ |
| 0° C. | 45.5 Ω | 37.1 Ω | 31.3 Ω | 23.8 Ω | 13.9 Ω |
| 10° C. | 47.8 Ω | 38.6 Ω | 32.3 Ω | 24.4 Ω | 14.1 Ω |
| 20° C. | 50.0 Ω | 40.0 Ω | 33.3 Ω | 25.0 Ω | 14.3 Ω |
| 30° C. | 52.3 Ω | 41.5 Ω | 34.3 Ω | 25.6 Ω | 14.5 Ω |
| 40° C. | 54.6 Ω | 42.9 Ω | 35.3 Ω | 26.1 Ω | 14.6 Ω |
| Temperature gradient | 0.228l/C. | 0.145l/C. | 0.105l/C. | 0.058l/C. | 0.018l/C. |

From the above results, it is clear that the stability of spout temperature with respect to variations in influent temperature can be assured during a continuous water discharge.

When washing water is spouted or discharged after the device has been inoperative for a long time period, e.g., 30 minutes or 20 hours, it is important that spout temperature not be too hot, e.g., it should not be above 40° C., or too cold, e.g., it should not be below 36° C.

In this regard, heating vessel 50 and storage vessel 51 are formed from a metal having a high thermal conductivity, and the vessels are continuously connected to one another in order to keep the water in storage vessel 51 warm.

However, because current is constantly supplied to heating elements 77 when the washing device is inoperative, the temperature in heating tank 50 settles at 46° C., which is the sensor temperature as seen in Table 1, and, according to experiments which have been performed, a temperature gradient of 4° C. occurs across vessels 50 and 51 even though they are formed from metals having high heat conductivity. The temperature within storage vessel 51 therefore remains at a level of approximately 42° C., which is too hot for water to be used for washing.

On the other hand, if current to heating element 77 is cut off during a long inoperative period, cold water (almost 0° C. during the winter) will be initially discharged when the washing device is used. This is detrimental to practical utilization of the device.

These problems are solved by the use of compensating sensor 57. More particularly, as seen in Table 2 hereinabove, the control circuit operates at a combined resistance equivalent to 80 ohms.

When water is stopped, the temperature at position "b" in FIG. 6B is maintained at a uniform level with other portions of heating vessel 50 so that sensor 64 and compensating sensor 57 will settle at substantially the same temperature level.

Figure 19:
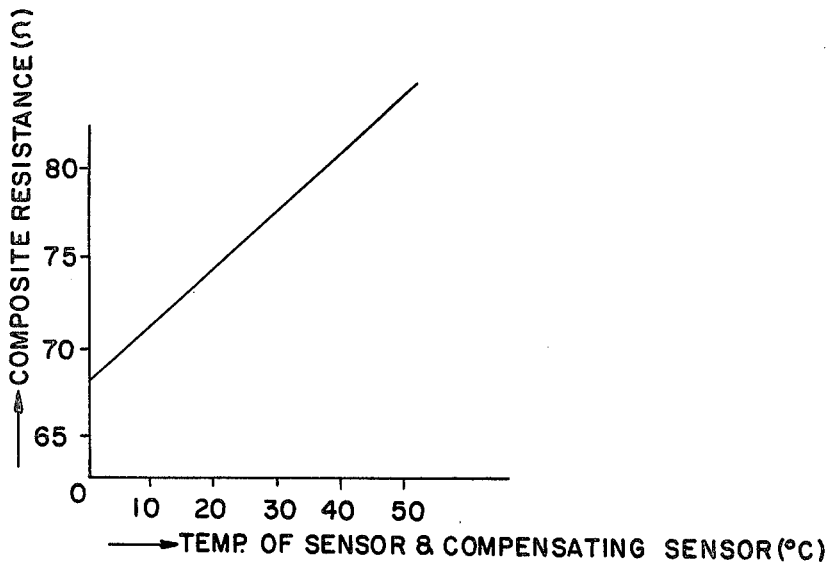
FIG. 19 is a graph of the composite resistance plotted as a function of the temperature of the sensor and compensating sensor.

As is clearly shown from the characteristics of composite resistance which are illustrated in the graph of FIG. 19, in a situation where the sensor and compensating sensor have the same temperature, the composite resistance becomes 80 ohms when the temperature of the sensor and compensating sensor is 42.5° C.

Since the temperature difference across the heating and storage vessels has been found to be 4° C. by experimentation, the temperature in storage vessel 51 is considered to settle at approximately 38° C.

The above description describes how compensating sensor 57 can maintain the temperature of washing water at a stable, suitable level during the time period when the washing device is inoperative.

Moreover, residual water within first vacuum breaker 16, which water is in communication with heated water in heat exchanger 15, is maintained almost at the same level by convection.

Figure 20:
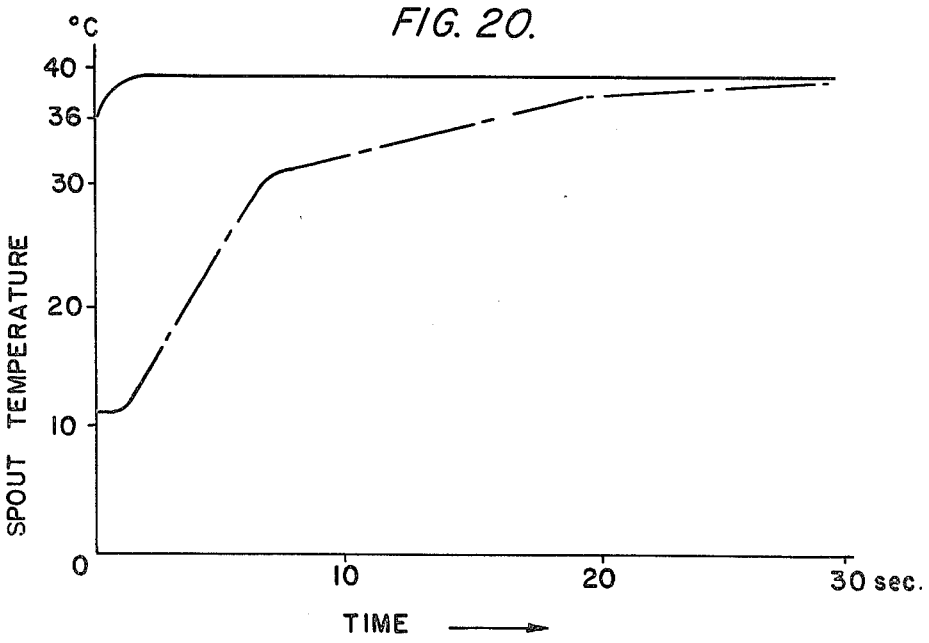
FIG. 20 is a graph illustrating the temperature range of spout water over time when using the present device.

Therefore, as indicated by the solid line in the graph of FIG. 20, spout water discharged will instantaneously achieve a comfortable temperature range of between 36° C. and 40° C. from the initial period of washing when the device is used after a period of inactivity, without spouting cold water. In this fashion, comfortable use is ensured. Conventional topical washing devices, in which washing water will reach a comfortable level after a delayed time period, as indicated by the broken line in the graph in FIG. 20, are clearly not as comfortable as the device of the present invention.

In the event that the water supply is suspended, water flow into heating vessel 50 will be stopped, and the temperature of water which is held in the heating vessel, which is in a quantity corresponding to a spout or discharge of approximately 1–2 seconds through the washing nozzle, will rise to approximately 45° C. However, because storage vessel 51 reserves heated water in a quantity which takes about 10 seconds when spouted through the washing nozzle, and because the thermal capacity of the heat exchanger as a whole is far greater than that of the overheated water, which is at 45° C., there is virtually no possibility of a temperature increase in the washing water which is spouted via storage vessel 51.

Similar effects can be obtained when the washing device is used intermittently.

Although the temperature in the storage tank is maintained at a constant level by the utilization of compensating sensor 57 as described hereinabove, it is also possible to utilize another sensor for detecting the temperature of storage vessel 51 and an additional control circuit for limiting the temperature increase which occurs when the washing device is at rest or inoperative, as described hereinabove. With regard to the circuit arrangement utilized, it is also possible to employ a system using an AND circuit.

From the foregoing description, one skilled in the art can easily ascertain the essential characteristics of this invention, and, without departing from the spirit and scope thereof, can make various changes and modifications of the invention to adapt it to various usages and conditions.

What is claimed is:

1. A topical washing device for cleaning a body portion of a user, said device comprising:

(a) a washing nozzle for discharging washing water towards said body portion;

(b) a water feed line connecting said washing nozzle to a source of water and adapted to conduct said water therethrough;

(c) a heat exchanger provided along said water feed line and forming a portion of said water feed line;

(d) a heater on said heat exchanger to heat water flowing through said heat exchanger;

(e) a sensor on said heat exchanger which is simultaneously sensitive to the temperature of the surface of said heater and the temperature of water discharged by said heat exchanger;

(f) a heat-sensitive safety switch on said heat exchanger which is adapted to cut off a power supply once water within said heat exchanger reaches a predetermined temperature level and to thereby deenergize an electromagnetic valve positioned along said water feed line upstream of said heat exchanger to terminate water supply to said heat exchanger and deactuate said heater to prevent overheating of water within said heat exchanger;

(g) a temperature controller electrically connected to said heater and said sensor to control the output of said heater in response to signals received from said sensor, said heat exchanger including a pair of juxtaposed vessels and a metallic conduit fluidically communicating said vessels, whereby said vessels and said conduit are comprised of high thermally conductive metal, said heater and said sensor being connected to one of said vessels, and the other of said vessels, which is positioned downstream of said one vessel along said feed line, having a volume sufficient to hold a predetermined quantity of washing water.

2. A topical washing device in accordance with claim 1 wherein said device is adapted to clean the anus of a user or other public body parts.

3. A topical washing device in accordance with claim 1 wherein said heat-sensitive switch is positioned on the upper surface of said one vessel.

4. A topical washing device in accordance with claim 1 wherein said heat-sensitive switch is positioned on an upper portion of said conduit.

5. A topical washing device in accordance with claim 1 wherein the volume of said other vessel is sufficient to hold a quantity of water equivalent to an approximately ten second discharge of water through said washing nozzle.

6. A topical washing device in accordance with claim 1 wherein said heat exchanger further comprises a compensating sensor located adjacent a water inlet of said one vessel, said compensating sensor adapted to compensate for variations in the temperature of water discharged from said washing nozzle which are caused by variations in the temperature of influent water from said source.

7. A topical washing device as defined by claim 1 wherein said temperature controller comprises an electric circuit including a thyristor acting as a switching element, said thyristor being positioned on said other vessel.

8. A topical washing device as defined by claim 1 wherein said heat-sensitive safety switch comprises a bi-metallic switch.

9. A topical washing device as defined by claim 1 wherein said heat exchanger is mounted in an inclined position and has a water outlet located on an upper portion thereof.

10. A topical washing device in accordance with claim 9 further comprising a vacuum breaker fluidically interconnecting said heat exchanger and said washing nozzle.

11. A topical washing device in accordance with claim 10 wherein said vacuum breaker comprises a synthetic resin material and is mounted on said heat exchanger at the same angle of inclination as the axis of said water outlet, and which is adapted to maintain a seat portion of said vacuum breaker in a horizontal position.

12. A topical washing device in accordance with claim 11 wherein said vacuum breaker is directly connected to said heat exchanger water outlet.

13. A topical washing device in accordance with claim 1 wherein said sensor and heater are positioned within said one vessel.

14. A topical washing device as described in claim 1 wherein said heater comprises a tubular aluminum base having a heating element and a sensor printed side-by-side on the surface of said base, and a very thin surface layer of aluminum covering said heating element and said sensor, said tubular body having an opening at one end which is connected to a water inlet of said heat exchanger and an opening at another end which is connected to an upstream portion of said water feed line to permit washing water to flow through said heater.

15. A topical washing device as defined by claim 14 wherein said heater comprises an axial bore which is fluidically connected to said water feed line via a flexible tube.

16. A topical washing device in accordance with claim 1 further comprising a casing including an open-bottomed cover and a bottom plate detachably secured to a bottom side of said cover, said bottom plate adapted to be attached to a rear top surface of a water closet.

17. A topical washing device in accordance with claim 16 wherein said water feed line and an operating switch main assembly are attached to said bottom plate and wherein said cover supports a manipulative portion of said operating switch and a water closet lid.

18. A topical washing device as defined by claim 17 wherein said bottom plate comprises a plurality of openings through which heads of bolts are adapted to be inserted and slide slots of a width smaller than said openings and which extend rearwardly from said openings, said bottom plate adapted to be attached to a water closet by said bolts.

19. A topical washing device in accordance with claim 18 wherein said bolts each has a head portion having dimensions generally corresponding to the width of said openings and an anti-rotational portion which is non-rotatably engageable with one of said slide slots.

20. A topical washing device in accordance with claim 17 wherein said casing comprises a molded synthetic resin material and includes a bottom surface having an inclined section upon which said heat exchanger is adapted to be mounted.

21. A topical washing device in accordance with claim 17 wherein said casing further comprises a lavatory seat and a lavatory lid, said casing adapted to be covered by said lid upon closing to conceal said nozzle and said water feed line from external view.

22. A topical washing device in accordance with claim 1 wherein said water feed line comprises a flow regulator valve, said electromagnetic valve, said heat exchanger, and a first vacuum breaker, said heat exchanger comprising said pair of vessels, said conduit, said heater, said sensor, and said switch.

* * * * *

UNITED STATES PATENT AND TRADEMARK OFFICE

CERTIFICATE OF CORRECTION

PATENT NO. : 4,370,764

DATED : February 1, 1983

INVENTOR(S) : Shizuka ANDO et al.

It is certified that error appears in the above-identified patent and that said Letters Patent is hereby corrected as shown below:

At column 1, line 45, change "saftey" to ---safety---;

At column 2, line 51, change "closet" to ---closets---;

At column 4, line 41, change "there by" to ---thereby---;

At column 6, line 16, change "public" to ---pubic---;

At column 13, line 1, change "discharged," to ---discharged---

At column 13, line 2, change "70° C.," to ---70° C.---; and

At column 14, line 6, change "56 ohm" to ---56 ohms---.

Signed and Sealed this

*Thirty-first* Day of *May 1983*

[SEAL]

*Attest:*

DONALD J. QUIGG

*Attesting Officer* *Acting Commissioner of Patents and Trademarks*